United States Patent [19]

Ritzenthaler et al.

[11] 4,097,832

[45] Jun. 27, 1978

[54] RELAY WITH MANUALLY RELEASABLE LATCH

[75] Inventors: Donald R. Ritzenthaler, Reedsburg; Frederick E. Erickson, Baraboo, both of Wis.

[73] Assignee: Gulf & Western Industries, Inc., New York, N.Y.

[21] Appl. No.: 775,713

[22] Filed: Mar. 9, 1977

[51] Int. Cl.[2] ..... H01H 9/20

[52] U.S. Cl. ..... 335/166; 335/186

[58] Field of Search ..... 335/164, 166, 168, 186, 335/170, 165; 200/321

[56] References Cited

U.S. PATENT DOCUMENTS

| | | | |
|---|---|---|---|
| 2,712,578 | 7/1955 | Theriault | 335/165 |
| 3,614,684 | 10/1971 | Egler | 335/166 |

*Primary Examiner*—George Harris

*Attorney, Agent, or Firm*—Meywer, Tilberry & Body

[57] ABSTRACT

An improvement in a latch relay of the type including a terminal support block, an armature pivotally mounted on a selected axis, coil means between the axis and the terminal blocks for forcing the armature into a first position adjacent the coil means when current is passed through the coil means, biasing means for biasing the armature away from the first position and toward a second position spaced from the coil means, a contact controlled by the angular position of the armature and a reset latching device. The latching device includes latch means responsive to movement of the armature from the second position to the first position for releasably latching the armature in the first position and manual means for releasing the latch means and allowing the armature to pivot into the second position. The improvement in this relay comprises a longitudinally movable, generally floating latch member movable between a latched position and a reset, unlatched position under the action of an integrally formed leaf spring coacting with the terminal block of the armature. This integral latch member includes a first shoulder for holding the latch member in the reset, unlatched position and an inclined wall for wedging the armature into its first position when the latch member is in its latched position.

11 Claims, 5 Drawing Figures a'>>b
a>>b a<<c
a'<<c
d ≐ 10°

RELAY WITH MANUALLY RELEASABLE LATCH

The present invention relates to the art of electromechanical relays and more particularly to an improvement in an electromechanical latch relay having a manual reset mechanism. The invention is particularly applicable for a double throw relay and it will be described with respect thereto; however, the invention has broader applications and may be used in various electromechanical reset relays of the type which are automatically latched when operated and manually unlatched for reset.

BACKGROUND OF INVENTION

For some time, electromechanical relays have been available with mechanisms for latching the relay closed when energized so that the relay must be manually released for subsequent operation. These relays are widely used in alarm systems, such as those adapted to monitor for excess conditions in hydraulic pressure, current and other operating characteristics of a control system. By using a releasable, latch relay an alarm circuit can be energized in response to an abnormal parameter of a controlled system. The alarm can discontinue operation of the controlled system and remain latched in the operative, or alarm, condition until manually reset. Thus, the case of the abnormal condition can be corrected and then the relay can be reset manually for subsequent monitoring of the system. A variety of structures has been adopted for this purpose. Prior U.S. Pat. Nos. 2,712,578 and 3,614,684 show structures for providing a latch relay. In U.S. Pat. No. 3,614,684, there is provided an outwardly extending, manually movable element for releasing the previously latched relay. These two patents are incorporated by reference herein for background information. Both of these patents provide relatively complex structures for latching the relay in the closed position. The movable members must move in relatively well defined planes, which require close manufacturing tolerances and complex assembly operations for placing the latching element into the relay. Also, these patents show composite structures which are assembled to produce the movable latching member. Consequently, relatively close tolerances must be maintained and the reliability of operation, which is critical in monitoring alarm systems, depends upon the maintenance of relatively strict tolerances which increases the cost of the relay. Since the relays are used in great numbers, this added cost of maintaining relatively strict tolerances and producing composite assembled latching members somewhat limits the commercial success of the structures illustrated in the prior art patents incorporated by reference herein.

These disadvantages of prior releasable latch relays have been overcome by the present invention which uses a unitary latch and release member for an electromechanical relay which requires relatively loose manufacturing tolerances and is inexpensive to manufacture and assemble.

THE INVENTION

In accordance with the present invention, there is provided an improvement in a releasable, latchable electromechanical relay of the type including a terminal block, an armature pivotally mounted on a selected axis, coil means between the axis and the terminal block for forcing the armature into a first position adjacent the coil means when current is passed through the coil means, biasing means for biasing the armature away from the first position and toward a second position spaced from the coil means, a contact controlled by the angular position of the armature and a reset latching device, which latching device includes latch means responsive to movement of the armature from the second position to the first position for releasably latching the armature in the first position and manual means for releasing the latch means and allowing the armature to pivot into the second position. The improvement in this type of manual reset relay includes the provision of a fixed abutment secured to the terminal block and spaced from the armature and the latching device includes an elongated, integral latching member movable longitudinally between a latched position and a reset, unlatched position and having an integral leaf spring means for creating a biasing action against the member in a direction extending from the reset position toward the latched position. The integral latch member also includes a shoulder coacting with an abutmen surface movable with the armature for holding the member in the reset position against the biasing action and an inclined surface intersecting the shoulder for wedging the latch member between the fixed abutment and the abutment surface when the armature is forced into the first position by current flowing through the coil means and means for manually and selectively moving the member from the latched position to the reset position. In accordance with a more limited aspect of the present invention, the integral latch member also includes a protuberance means on the member and extending toward the fixed abutment when the member is in its latched position. This protuberance is used in the wedging action of the latch member to cause a wedging action which allows relatively loose dimensional tolerances and allows the latch member to float somewhat during movement between the latched and unlatched position.

The primary object of the present invention is the provision of a manually releasable, latch relay, which relay is economical to produce, requires less stringent tolerances, can be used in existing relays, and requires only minor design changes over existing relays.

Another object of the present invention is the provision of a manually releasable, latch relay, which relay uses a generally floating latch member loosely held within the relay.

Still a further object of the present invention is the provision of a manually releasable, latch relay, which relay uses an integral, one-piece latch member including an integral biasing spring and an integral guide means for allowing a slight floating action of the latch member as it moves between its latched and unlatched positions.

Still a further object of the present invention is the provision of a manual releasable latch relay as described above, which relay is reliable in operation over many cycles and is easy to manufacture and assemble.

These and other objects and advantages will become apparent from the following description.

BRIEF DESCRIPTION OF DRAWINGS

In the description, the following views are incorporated.

PREFERRED EMBODIMENT

Figure 1:
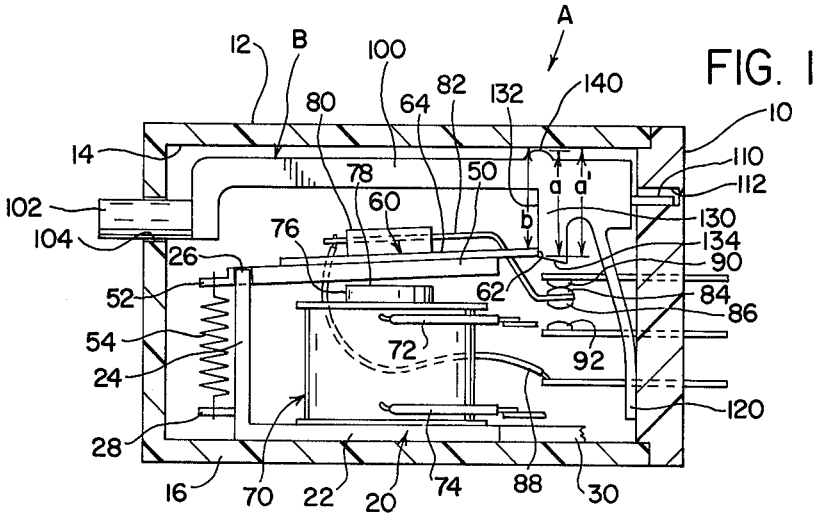
FIG. 1 is a partially cross-sectioned side elevational view illustrating, somewhat schematically, the preferred embodiment of the present invention with the latch member in the reset position.
Figure 2:
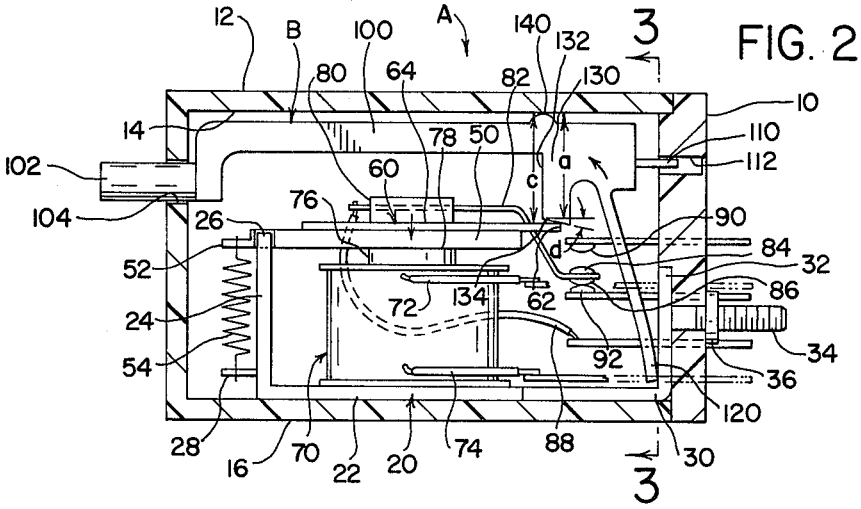
FIG. 2 is a partially cross-sectioned side elevational view similar to FIG. 1 showing the latch member in the latched position.
Figure 3:
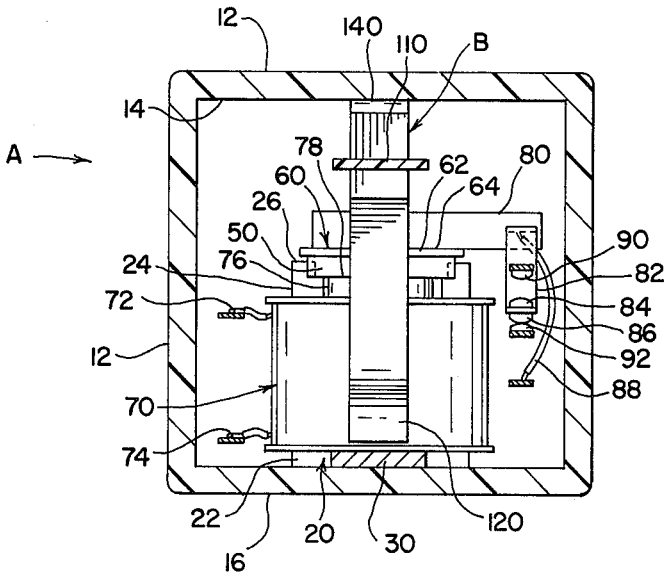
FIG. 3 is a partially cross-sectioned view taken generally along line 3—3 of FIG. 2.

Referring now to the drawings wherein the showings are for the purpose of illustrating a preferred embodiment of the invention only and not for the purpose of limiting same, FIGS. 1–3 show a latch relay A having a terminal block 10 for supporting a plurality of terminals in accordance with standard relay construction. Around the relay there is provided an appropriate plastic cover 12 which has an inner generally flat abutment wall 14 and a wall 16 spaced therefrom. Within the cover there is provided a standard support bracket 20 having an enlarged upper portion 22 with a generally orthogonal 24 terminating in an upper fulcrum 26. Below the fulcrum there is provided a tab 28 for a purpose to be described later. Bracket 20 also includes an integral smaller portion 30 having an orthogonal leg 32 recessed in and fixed on terminal block 10 by an appropriate means, such as a bolt 34 and nut 36. In this manner, the support bracket is fixedly secured onto the standard terminal block 10 for mounting components within the cavity defined by cover 12. The cover slips over bracket 20 and is secured by any appropriate arrangement onto block 10 to provide a unitary structure, as schematically illustrated in FIGS. 1–3.

An armature 50 formed from a high permeable material, such as soft magnetic iron, is provided with a rear lug 52 generally spaced from tab 28 and pivotally mounted about fulcrum 26 in accordance with standard relay design concepts. A tension spring 54 biases armature 50 in a counterclockwise direction, as shown in FIGS. 1 and 2. In accordance with this particular illustrated relay design, an insulator 60 is secured over armature 50 and is, in essence, a part of the armature although it is formed from an insulated material and is carried by armature 50 as it pivots about fulcrum 26 which forms an axis generally perpendicular to the view shown in FIGS. 1 and 2. Insulator 60 is a generally blade-like structure terminating in a generally straight edge 62 and having an upper surface 64, at least adjacent edge 62. To pivot armature 50 and, thus, insulator 60 about fulcrum or axis 26, there is provided a coil means 70 having input leads 72, 74 and an upwardly facing, generally cylindrical pole piece 76 having a flat surface which corresponds with a lower flat surface of armature 50 when the armature is drawn into engagement with the pole piece by passing current through the coil means 70 by leads 72, 74. Onto the insulator there is provided a contact holder 80 supporting contact blade 82 for movement with armature 50. The contact blade includes, in the illustrated embodiment, vertically spaced contacts 84, 86 each of which are connected by blade 82 to a common line 88. Output terminals or contacts 90, 92 coact with contacts 84, 86, respectively, as armature 50 is shifted between the de-energized or opened position shown in FIG. 1 to the energized or closed position of FIG. 2. Thus, armature 50 is movable between first and second positions which positions can be determined by the spacing between contacts 84, 86 and their associated contacts 90, 92. In other words, armature 50 pivots about axis or fulcrum 26 between a first position with one set of contacts closed and the second position with the other set of contacts closed. This provides a double throw output for relay A. When electrical current is flowing through coil means 70, armature 50 contacts the upper pole surface 78 of pole piece 76. This is a tight contact and biases blade 82 to apply a desired pressure between contacts 86 and 92. When current is released and armature 50 is pivoted in a counterclockwise direction, spring 54 applies the desired pressure between contacts 84 and 90. Consequently, armature 50 is movable between two positions according to the presence of current flow through coil means 70. This operation is standard relay technology and is not part of the present invention.

In accordance with the present invention, there is provided a novel latch member B which is an integral one-piece member formed from molded plastic. In practice, the molded plastic is Delrin manufactured and distributed by DuPont Company of Wilmington, Delaware. Member B includes a longitudinally extending main body portion 100 having an outwardly extending, generally cylindrical neck 102 protruding through circular opening 104 in cover 12. At the opposite end of body portion 100 there is provided a generally flat guide tongue 110 extending into opening 112, which opening may be a standard opening provided for a terminal in terminal block 10 or it can be a specially prepared and molded recess or opening. By using a standard terminal opening, block 10 need not be modified from existing block when incorporating latch member B. As illustrated, flat guide tongue 110 has a selected thickness which is somewhat smaller than the transverse dimension of opening or recess 112. In this manner, member B can float laterally with respect to longitudinal body portion 100 to provide a floating action determined by the clearance in recess 112 and the clearance between neck 102 and opening 104. By providing this floating action, tolerances for member B are less critical and assembly of member B is appreciably simplified. Integrally formed on member B is an outwardly extending leaf spring 120 extending toward terminal block 10 for biasing member B longitudinally toward opening 104. Leaf spring 120 is compressed and deformed by pushing member B longitudinally toward base 10 by cylindrical neck 102. Extending from main body portion 100 there is provided a control abutment 130 formed integrally with the body portion and including a forwardly facing, generally flat shoulder 132 having a lower edge terminating in an inclined wall 134 which is tapered away from shoulder 132 toward terminal block 10 and wall 16. This inclined wall has a front edge 136 and a rear edge 138, shown in FIG. 4, and is used in conjunction with an integral protuberance 140 which in practice has a transversely extending, partial cylindrical form and extends from body portion 100 toward abutment wall 14. By providing such a protuberance extending toward abutment wall 14, the protuberance itself hits abutment wall 14 and causes a wedging action to be described later. Consequently, body portion 100 need not be dimensioned to ride along and slide with respect to wall 14 which would cause substantial friction and require more precise manufacturing tolerances. Thus, a protuberance, such as protuberance 140, forms one aspect of the invention although it is possible to provide member B without such protuberance since the member floats in the cavity defined by wall 12 and generally above armature 50.

In operation, leaf spring 120 biases latch member B to the left, as shown in FIGS. 1 and 2. During normal conditions, armature 50 is in the position shown in FIG. 1. In this position, generally flat edge 62 engages shoulder 132. This holds member B in the retracted, unlatched position shown in FIG. 1. When current is directed through coil means 70, pole 76 is energized which magnetically attracts armature 50 against the pole surface 78, as shown in FIG. 2. When this happens, leaf spring 120 forces member B to the left wherein inclined wall 134 rides over surface 64 of insulator 60 and wedges member B between this surface and abutment wall 14. The wedging action is between inclined surface 134 and the upper extremity of integral protuberance 140. Leaf spring 120 forces member B to the left so that the wedging action occurs. In this manner, guide tongue or blade 110 moves upwardly in recess or opening 112 of terminal block 10. This allows a slight floating action. The same floating action could occur by clearance between neck 102 and opening 104 in cover 12.

As illustrated in FIGS. 1 and 2, the distance *a* is the distance between the top of protuberance 140 and intersecting edge 136 between shoulder 132 and inclined wall 134. Distance *b* is the spacing between abutment wall 14 and the upper position of surface 64 when armature 50 has been released and pivoted by spring 54. In the unlatched position, distance *a* is substantially greater than distance *b* so that the lower edge of shoulder 132 is below upper edge 64 of the outward blade-like portion of insulator 60. This provides an interference abutment relationship which will maintain member B in the reset or unlatched position. The distance *a'* is the distance between abutment wall 14 and the lower edge 136 of shoulder 132. This may be slightly greater than distance *a* in the unlatched position, since member B is allowed to float within the cavity defined above armature 50. However, this distance is also substantially greater than the distance *b* so that irrespective of the floating position of member B, insulator 60 retains member B in the reset, unlatched position shown in FIG. 1. Thereafter, when the coil means 70 is energized, armature 50 is pivoted downwardly in a clockwise direction into the closed position shown in FIG. 2. At that time, spring means 120 biases latch member B to the left over insulator 60. Inclined wall 134 then wedges member B between abutment wall 14 and the upper surface 64 of insulator 60. This provides the latched position for member B which is retained until the member is manually depressed by neck 102. In practice, the angle *d* of inclined wall 134 is approximately 10°; however, other gradual angles or contours could be provided without departing from the intended spirit and scope of the invention. In FIG. 2, the distance *c* is the spacing between abutment wall 14 and the upper surface 64 of insulator 60 in the area of edge 62. As can be seen, distance *c* is substantially greater than distance *a* so that edge 62 is engaged by inclined wall 134 when armature 50 is closed, as shown in FIG. 2. Of course, the distance *c* must not be greater than the spacing of rear edge 138 of surface 134 from wall 14. Thus, in the closed position, wall 134 is engaged with edge 62 and surface 64, as shown in FIG. 2. When in the position shown in FIG. 2, latch member B holds armature 50 in the closed position with contact 86 engaging contact 92. As current is discontinued through coil means 70, armature 50 does not move because it is wedged in the closed position by member B. Consequently, to unlatch relay A and allow armature 50 to pivot in a counterclockwise direction into the unlatched condition with contact 84 engaging contact 90, it is necessary to manually depress neck 102. During such depression, tongue 110 moves inwardly within recess 112 and surface 134 disengages insulator 60. This allows spring 54 to shift armature 50 in the unlatched, opened position. Thereafter, as pressure is released from neck 102 member B shifts into the position shown in FIG. 1 with shoulder 132 engaging edge 62 of insulator 60. This holds member B in a biased position awaiting a subsequent actuation of coil means 70.

Figure 4:
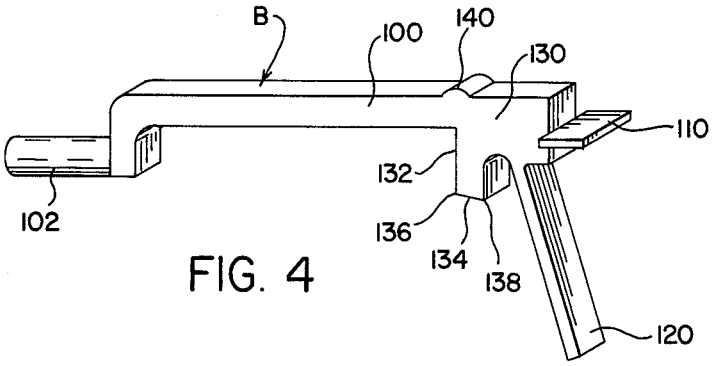
FIG. 4 is an enlarged, pictorial view illustrating a latch member constructed in accordance with a preferred embodiment of the present invention; and, FIG. 5 is a schematic wiring diagram illustrating the environment in which the preferred embodiment of the present invention can be used.

FIG. 4 illustrates the preferred embodiment of latch member B. Of course, certain design changes could be made in this member without departing from the intended spirit and scope of the invention which relates to an integral latch member which can be assembled as a unit into relay A for converting the relay to a latched and manually releasable type of operation.

Figure 5:
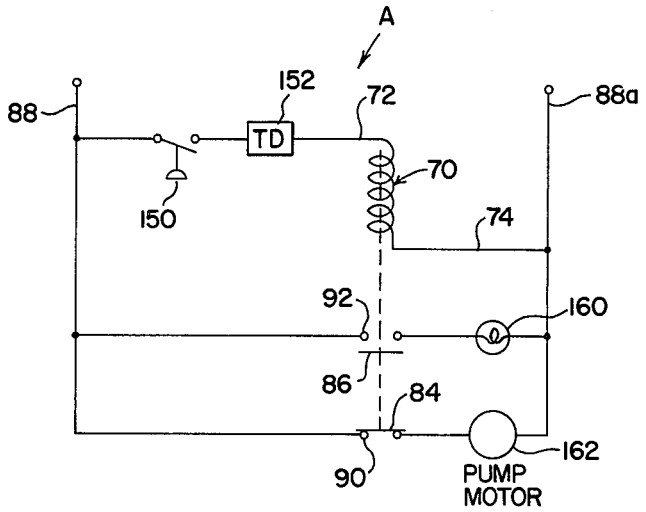

Referring now to FIG. 5, a control system of the type which could employ relay A is illustrated. In this system, the electrical control voltage is applied between line 88 and line 88*a* to monitor pressure within the hydraulic system. As the pressure increases, a pressure responsive switch 150 is closed at a selected high pressure. If this pressure remains for a time delay determined by time delay device 152, coil means 70 is energized by current flow through lines 72, 74 between lines 88, 88*a*. When this happens, armature 50 is shifted to the position shown in FIG. 2 which closes contact 86 against contact 92. This illuminates an alarm light 160. In a like manner, contact 84 is opened with respect to contact 90 to de-energize pump motor 162. After light 160 is illuminated and motor 162 is de-energized, the motor can be restarted if pressure measured by switch 150 has been decreased to open switch 150. This will de-energize coil 70 and allow armature 50 to shift into the position shown in FIG. 1 when neck 102 is manually depressed forcing member B to the right to a position at least as far as the position illustrated in FIG. 1. If the pressure has not been decreased at switch 150, armature 50 will remain in the position shown in FIG. 2; therefore, when member B is manually released it will shift again to the position shown in FIG. 2. The system of FIG. 5 is used for illustrative purposes only and relay A will have a variety of uses.

Having thus defined the invention, it is claimed:

1. In a manual reset relay including a terminal support block, an armature pivotally mounted on a selected axis, coil means between said axis and said terminal block for forcing said armature into a first position adjacent said coil means when current is passed through said coil means, biasing means for biasing said armature away from said first position and toward a second position spaced from said coil means, a contact controlled by the angular position of said armature and a reset latching device, said latching device including latch means responsive to movement of said armature from said second position to said first position for releasably latching said armature in said first position and manual means for releasing said latch means and allowing said armature to pivot into said second position, the improvement comprising: longitudinally extending wall means secured with respect to said terminal block and extending over said armature and defining a clearance cavity between said wall means and said armature, said latching device including an integral latch member generally floating in said cavity and manually movable in a longitudinal direction generally perpendicular to said selected axis and parallel to said wall means, said latch member comprising an abutment having a generally flat shoulder extending laterally between said wall means and said armature and generally between said coil means and said terminal block and a wall inclined from said shoulder and away from said wall means and toward said block, a guide pin extending longitudinally into a recess in said terminal block, said recess being transversely larger than said guide pin for allowing lateral movement of said latch member in said cavity, a protuberance generally aligned with said inclined wall and extending from said member toward said wall means, an integral leaf spring biasing said member in a direction away from said terminal block, said shoulder of said abutment and said armature coacting to hold said latch member in a reset position against the biasing action of said leaf spring when said armature is in said second position and when said armature is in said first position, said member being biased by said leaf spring into a latched position with said protuberance and said inclined wall wedge between said armature and said wall means and said latch member including a portion protruding from said relay in a direction away from said terminal block for manually shifting said member from said latched position to said reset position.

2. The improvement as defined in claim 1 including a blade-like armature abutment element fixed with respect to said pivotally mounted armature, said blade-like element having a generally straight outboard edge generally parallel to said axis and facing said terminal block and an upper surface adjacent said edge, said protuberance having an outermost portion spaced from an innermost portion of said shoulder a selected first distance, said upper edge surface of said blade-like element being spaced from said wall means a second selected distance when said armature is in said second selected distance, said second selected distance being substantially less than said first selected distance.

3. The improvement as defined in claim 2 wherein said upper edge surface of said blade-like element is spaced from said wall means a third selected distance when said armature is in said first position, said selected third distance being substantially greater than said first selected distance.

4. The improvement as defined in claim 3 wherein said inclined wall extends between a first edge of said shoulder and a second portion spaced from said first edge, said second portion being spaced from said wall means a fourth selected distance, said fourth selected distance being substantially greater than said third selected distance.

5. A manual reset member for automatically latching the pivotally mounted, spring biased armature of a relay in its closed position and movable in a longitudinal direction into a reset position releasing said armature from said closed position for spring biased movement of said armature, said member comprising a body member having a first end with a manual reciprocating element and a second end with a longitudinally extending guide pin adapted to provide a controlled, generally floating, longitudinal movement of said member, an integral leaf spring element extending in a first lateral direction and in an outwardly and longitudinal direction, a protuberance intermediate said first and second ends and extending laterally outwardly from said body in a second direction opposite to said first lateral direction, and an armature control abutment extending in said first lateral direction and having a generally flat shoulder facing said first end and an outwardly inclined wall extending from said shoulder in said first direction and toward said second end.

6. In a manual reset relay including a terminal support block, an armature pivotally mounted on a selected axis, coil means between said axis and said terminal block for forcing said armature into a first position adjacent said coil means when current is passed through said coil means, biasing means for biasing said armature away from said first position and toward a second position spaced from said coil means, a contact controlled by the angular position of said armature and a reset latching device, said latching device including latch means responsive to movement of said armature from said second position to said first position for releasably latching said armature in said first position and manual means for releasing said latch means and allowing said armature to pivot into said second position, the improvement comprising: longitudinally extending wall means secured with respect to said terminal block and extending over said armature and defining a clearance cavity between said wall means and said armature, said latching device including an integral latch member generally floating in said cavity and manually movable in a longitudinal direction generally perpendicular to said selected axis and parallel to said wall means, said latch member comprising an abutment having a generally flat shoulder extending laterally between said wall means and said armature and generally between said coil means and said terminal block and a wall inclined from said shoulder and away from said wall means and toward said block, a guide pin extending longitudinally into a recess in said terminal block, said recess being transversely larger than said guide pin for allowing lateral movement of said latch member in said cavity, a protuberance generally aligned with said inclined wall and extending from said member toward said wal means, an integral leaf spring biasing said member in a direction away from said terminal block, said shoulder of said abutment and said armature coacting to hold said latch member in a reset position compressed against the biasing action of said leaf spring when said armature is in said second position and, when said armature is in said first position, said member being biased by said leaf spring in a latched position with said protuberance and said inclined wall wedged between said armature and said wall means.

7. The improvement as defined in claim 6 including a blade-like armature abutment element fixed with respect to said pivotally mounted armature, said blade-like element having a generally straight outboard edge generally parallel to said axis and facing said terminal block and an upper surface adjacent said edge, said protuberance having an outermost portion spaced from an innermost portion of said shoulder a selected first distance, said upper edge surface of said blade-like element being spaced from said wall means a second selected distance when said armature is in said second selected distance, said second selected distance being substantially less than said first selected distance.

8. The improvement as defined in claim 7 wherein said upper edge surface of said blade-like element is spaced from said wall means a third selected distance when said armature is in said first position, said selected third distance being substantially greater than said first selected distance.

9. The improvement as defined in claim 8 wherein said inclined wall extends between a first edge of said shoulder and a second portion spaced from said first edge, said second portion being spaced from said wall means a fourth selected distance, said fourth selected distance being substantially greater than said third selected distance.

10. In a manual reset relay including a terminal support block, an armature pivotally mounted on a selected axis, coil means between said axis and said terminal block for forcing said armature into a first position adjacent said coil means when current is passed through said coil means, biasing means for biasing said armature away from said first position and toward a second position spaced from said coil means, a contact controlled by the angular position of said armature and a reset latching device, said latching device including latch means responsive to movement of said armature from said second position to said first position for releasably latching said armature in said first position and manual means for releasing said latch means and allowing said armature to pivot into said second position, the improvement comprising: a fixed abutment secured to said terminal block and spaced from said armature, said latching device including an elongated, integral latch member movable longitudinally between a latched position and a reset, unlatched position, an integral leaf spring means for creating a biasing action against said member from said reset position toward said latched position, a shoulder on said member coacting with an abutment surface movable with said armature for holding said member in said reset position against said biasing action, an inclined surface intersecting said shoulder for wedging said member between said fixed abutment and said abutment surface when said armature is forced into said first position by current flow through said coil means and means for manually and selectively moving said member from said latched position to said reset position.

11. The improvement as defined in claim 10 including a protuberance means on said member and extending toward said first abutment for engagement with said fixed abutment when said member is in said latched position.

* * * * *